United States Patent [19]

Fillman et al.

[11] Patent Number: 4,653,522

[45] Date of Patent: Mar. 31, 1987

[54] GROUND HYDRANT AND METHOD FOR OPERATING SAME

[75] Inventors: Russell L. Fillman; Reinhard Srajer, both of Colorado Springs, Colo.

[73] Assignee: Woodford Manufacturing Company, Colorado Springs, Colo.

[21] Appl. No.: 882,778

[22] Filed: Jul. 7, 1986

[51] Int. Cl.[4] ..... E03B 9/04; E03B 9/14

[52] U.S. Cl. ..... 137/1; 137/281; 137/301; 137/302; 251/73; 251/89; 251/94; 251/111; 251/279

[58] Field of Search ..... 137/1, 2, 272, 281, 137/282, 301, 302, 303, 307; 251/73, 89, 94, 111, 231, 242, 279

[56] References Cited

U.S. PATENT DOCUMENTS

| | | | |
|---|---|---|---|
| 609,805 | 8/1898 | Hardy | 137/281 |
| 824,770 | 7/1906 | Williams | 137/301 |
| 2,630,130 | 3/1953 | Murdock et al. | 137/281 |
| 2,648,349 | 8/1953 | McGarry | 137/302 |
| 3,534,762 | 10/1970 | Noland | 137/301 |
| 3,770,000 | 11/1973 | Murdock et al. | 137/281 |
| 3,770,003 | 11/1973 | Uroshevich | 137/281 |
| 4,096,877 | 6/1978 | Arledge, II | 137/301 |
| 4,109,671 | 8/1978 | Hughes et al. | 137/282 |
| 4,282,895 | 8/1981 | Young | 137/301 |
| 4,520,836 | 6/1985 | Hutter, III | 137/301 |

*Primary Examiner*—George L. Walton

*Attorney, Agent, or Firm*—Zarley, McKee, Thomte, Voorhees & Sease

[57] ABSTRACT

The ground hydrant of the present invention includes an outlet nozzle above ground and a drain water collection cylinder located below the frost line of the ground. When the hydrant is shut off, the residual water in the nozzle drains into the ground water cylinder and is stored there below the frost line. The next time that the hydrant is turned on, the piston within the cylinder forces the stored water in the cylinder outwardly through a drain line where it is expelled above the ground. The force for moving the piston within the cylinder is provided by water pressure which is diverted from the water source to move the piston and force the stored drain water out of the cylinder and onto the ground. When the hydrant is turned off a second time, the residual water within the hydrant drains again into the cylinder where it is stored until the next time the hydrant is turned on.

6 Claims, 9 Drawing Figures

GROUND HYDRANT AND METHOD FOR OPERATING SAME

BACKGROUND OF THE INVENTION

This invention relates to a ground hydrant and method for operating same.

Ground hydrants include a nozzle and a handle above ground, and further include a lower end which is positioned below the frost line in the ground where it is connected to a source of water pressure. In order to prevent freezing of the ground hydrant, a drain hole is usually provided at the lower end of the hydrant for permitting the residual water within the hydrant to drain downwardly and outwardly through the hydrant below the frost line. This prevents any water from remaining in the hydrant and freezing during cold weather.

It is desirable to provide a hydrant which permits the drain water to be released above ground rather than below ground so as to avoid the possibility of contamination getting into the hydrant due to any malfunction of the device. It is also preferable that the drain water not exit through the nozzle during the next use of the hydrant because the drain water can become contaminated if the hydrant has not been operated for a long period of time.

Therefore, a primary object of the present invention is the provision of an improved ground hydrant and method for operating same.

A further object of the present invention is the provision of a ground hydrant which includes a reservoir below the frost line for receiving the residual water within the hydrant after the water has been shut off.

A further object of the present invention is the provision of a ground hydrant which permits the forceable expelling of the drain water stored within the reservoir each time the hydrant is turned on.

A further object of the present invention is the provision of a ground hydrant wherein the stored drain water is kept entirely separate from the fresh potable water supply of the hydrant so as to prevent contamination.

A further object of the present invention is the provision of a ground hydrant wherein the stored drain water is expelled through a drain line above ground and separate from the nozzle where fresh potable water normally exits.

A further object of the present invention is the provision of a freezeless ground hydrant wherein the drain water is not expelled through the nozzle of the hydrant.

A further object of the present invention is the provision of a freezeless ground hydrant wherein the drain water is not expelled below the ground, but is instead expelled above the ground each time the hydrant is turned on.

A further object of the present invention is the provision of a ground hydrant which is encased in tubing from ground level down to the water inlet connection so as to protect the operating linkages and valves of the hydrant.

A further object of the present invention is the provision of a ground hydrant which can easily be removed for repair without requiring the digging up of the hydrant.

A further object of the present invention is the provision of a freezeless ground hydrant which automatically expels the drain water by the use of water pressure from the water source.

A further object of the present invention is the provision of a freezeless ground hydrant which includes an automatic shut-off valve which is part of the hydrant that remains underground, and which shuts off the water flow when the hydrant is removed, thereby eliminating the need to shut off the water main during repair of the hydrant.

SUMMARY OF THE INVENTION

The ground hydrant of the present invention is a lever operated, freezeless hydrant, which stands approximately three feet above the ground and which is buried within the ground to a depth of approximately one to seven feet, depending upon the normal penetration of the frost line in the particular location where the hydrant is used. The hydrant includes a main valve for directing the water flow within the hydrant, and also includes a drain water collection system having a cylinder adapted to act as a reservoir for the drain water. During operation of the hydrant, the main valve directs water from the water source upwardly through a nozzle which is located above the ground.

The lever for operating the valves includes three positions. When the lever is moved to the off position, water is permitted to drain downwardly from the nozzle into the cylinder of the drain water reservoir system. Water is retained within this cylinder until the next time that the hydrant is turned on.

When the hydrant is turned on, the lever handle is moved to a purge position which opens a three way valve between the water supply and the reservoir cylinder. As the water pressure from the water supply is introduced to the reservoir cylinder, it causes the piston within the cylinder to force the stored drain water outwardly from the piston through a drain line which expels the water above ground.

From the purge position, the lever handle is next moved to an on position which causes the main valve to connect the water source to the outlet nozzle of the hydrant for normal use.

When it is desired to turn off the hydrant, the lever handle is moved from the on position back to the purge position which shuts off the water source from the nozzle of the hydrant. The lever handle is then moved from the purge position to the off position which permits the water to drain downwardly from the nozzle and also from the drain line into the reservoir cylinder.

The next time the hydrant is turned on, the water within the drain cylinder is again forced outwardly through the drain line above the ground prior to the time that the hydrant is turned completely on.

The main valve and drain water collection/expulsion system and water inlet connection are located underground below frost penetrating depth. The hydrant is designed to be easily removed for service and repair by simply unbolting it at ground level. An automatic shut-off valve which is part of the hydrant that remains underground shuts off the water flow when the hydrant is removed, thereby eliminating the need to shut off the water main.

An important feature of the present invention is the use of a three-way valve controlled by the operating lever which permits the use of the water pressure from the water source to actuate the cylinder to expel the water through a pipe above the ground. This is done automatically as the lever handle is moved from the off position to a purge position to the on position.

The hydrant is encased in a tubing from ground level down to the water inlet connection. The function of the casing is to protect the operating linkages and valves of the hydrant and to facilitate easy removal without requiring any digging.

DETAILED DESCRIPTION OF THE PREFERRED EMBODIMENT

Figure 2:
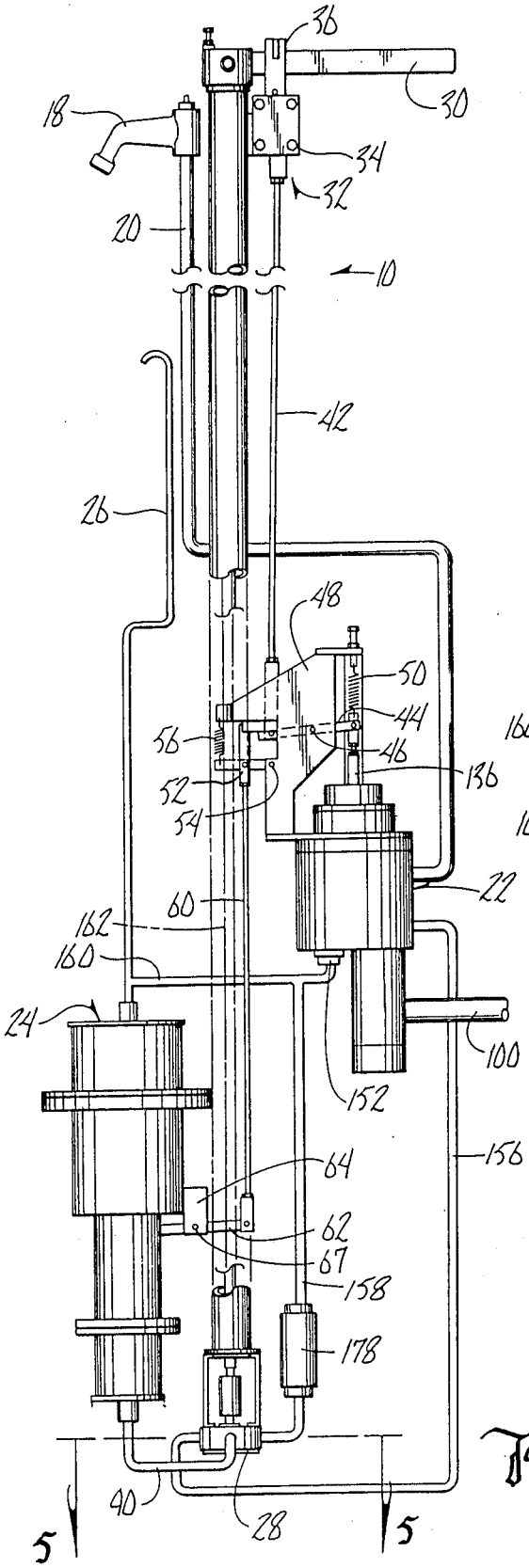
FIG. 2 is an elevational view showing the internal parts of the hydrant and their interconnection.
Figure 1:
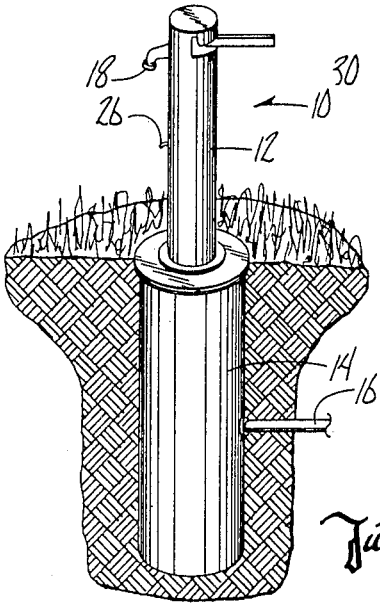
FIG. 1 is a perspective view of the hydrant.

Referring to the drawings, the numeral 10 generally designates the hydrant of the present invention. Hydrant 10 is enclosed within an upper casing 12 and an underground casing 14, and is adapted to be connected to an underground water line 16 located below the frost line.

Hydrant 10 includes an outlet nozzle 18 which is connected by a line 20 to a main valve 22. Main valve 22 is also connected to a drain water storage system 24 which includes a drain line 26 for expelling the drain water above ground.

Figure 3:
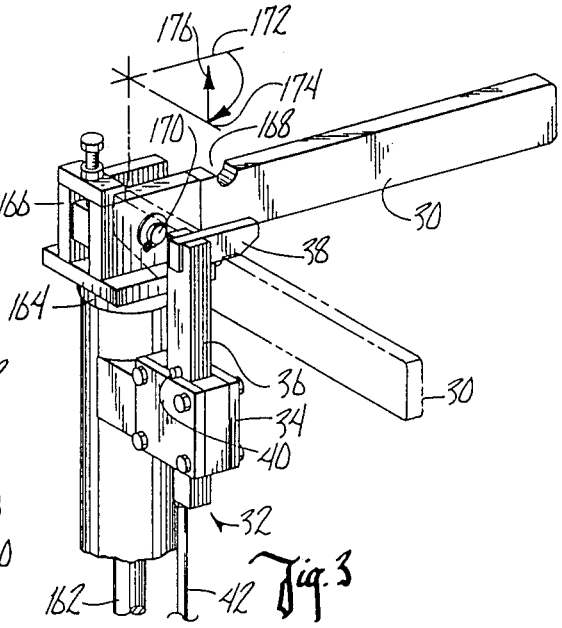
FIG. 3 is an enlarged prospective view of the lever handle of the hydrant.

Connected between the main valve 22 and the drain water storage system 24 is a three-way valve 28 which is manually operated by lever handle 30 above ground. Lever handle 30 also operates main valve 22 by virtue of a linkage mechanism 32. Linkage mechanism 32 includes a slide mount 34 which retains an actuator member 36 having a pawl or finger 38 therein. Actuator member 36 is vertically movable within slide mount 34, but is limited in its downward movement by pin 40 (FIG. 3). Actuator member 36 is connected by a rod 42 to a pivot link 44 which is pivotally mounted about axis 46 to a mounting bracket 48 which also supports main valve 22. The opposite end of pivot link 44 is normally urged upwardly by means of a spring 50 which is also attached to mounting bracket 48. Thus, link 44 is normally urged in a counterclockwise direction by spring 50 thereby causing the actuator member 38 to normally be biased downwardly to its lowermost position as shown in FIG. 3.

Figure 6:
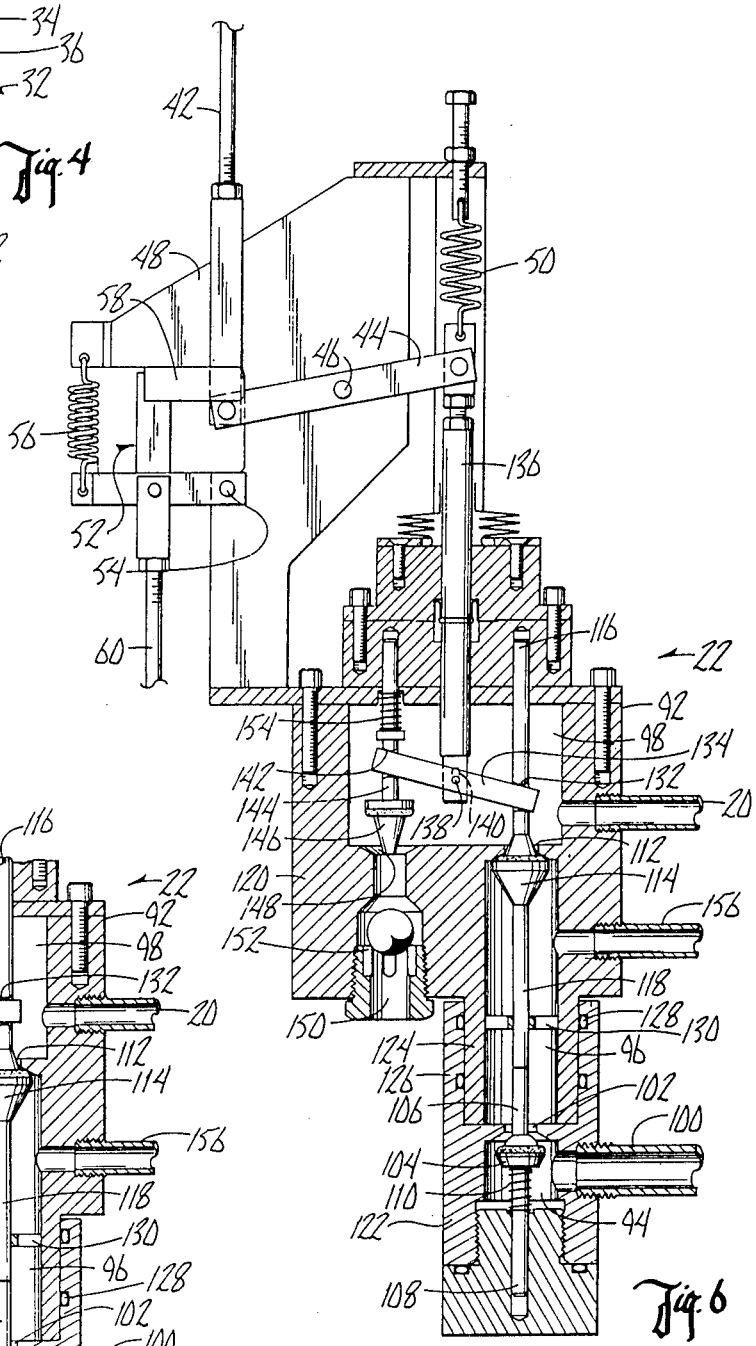
FIG. 6 is a sectional view of the main valve of the present invention, showing the position of the valve when the valve is in the drain position.

Pivot link 44 is normally locked in the position shown in FIG. 6 by means of a locking member 52 which is pivoted to bracket 48 for pivotal movement about axis 54. A spring 56 urges locking member 52 in a clockwise direction about axis 54 so that the finger 58 of locking member 52 engages the end of pivot link 44. However, locking member 52 is pivotal in a counterclockwise direction about axis 54 against the bias of spring 56 to the position shown in FIG. 8 so as to release pivot link 44 and permit pivot link 44 to rotate about axis 46.

Connected to locking member 52 and extending downwardly therefrom is a rod 60 which is connected at its lower end to a pivot link 62 which is pivotally mounted to a bracket 64 mounted on the outside of a cylinder 66 forming a part of drain water system 24. Pivot link 62 pivots about an axis 67 and includes one end 68 protruding within a slot 70 in the cylinder 66.

Cylinder 66 includes a two-headed piston 72 having an upper head 74, and a lower head 76 which are interconnected by a tube or shaft 78 and rod 80. Upper head 74 and lower head 76 divide cylinder 66 into a drain water chamber 82 and a pressure water chamber 84.

Figure 9:
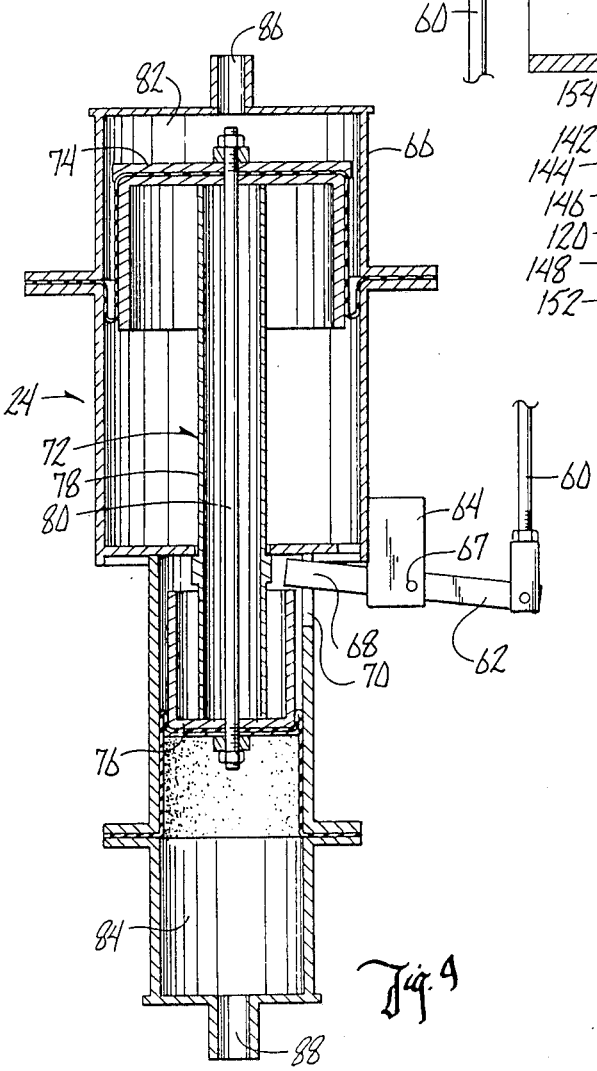
FIG. 9 is a sectional view of the reservoir cylinder of the present invention.

As can be seen in FIG. 9, the lower head 76 is adapted to engage end 68 of link 62 when the piston 72 moves to its upper position, thereby causing clockwise rotation of link 62 which pulls downwardly on rod 60 and causes locking member 52 to rotate against the bias of spring 56 in a counterclockwise direction so as to release the locking engagement of finger 58 to link 44.

Cylinder 66 includes a drain opening 86 which provides communication between drain water chamber 82 and drain line 26. Cylinder 66 also includes a pressure opening 88 which is adapted to be connected to a water line 90 leading to three-way valve 28.

Figure 7:
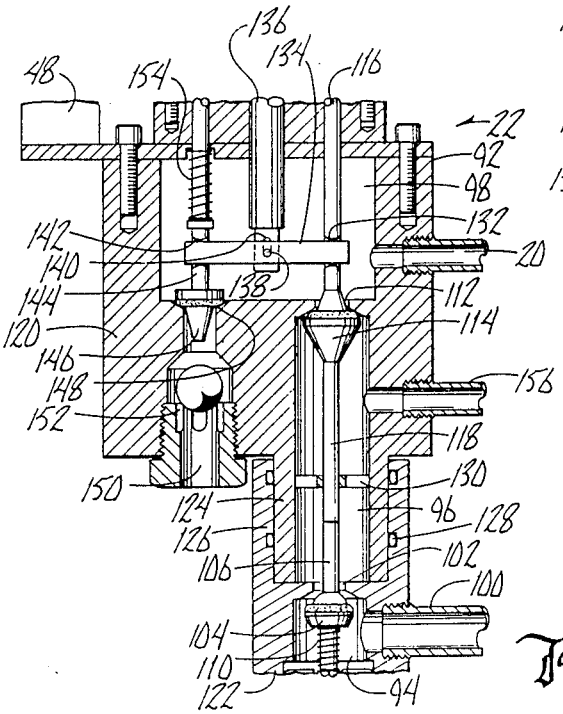
FIG. 7 is a sectional view similar to FIG. 6 showing the position of the valve when the hydrant is in the off position.
Figure 8:
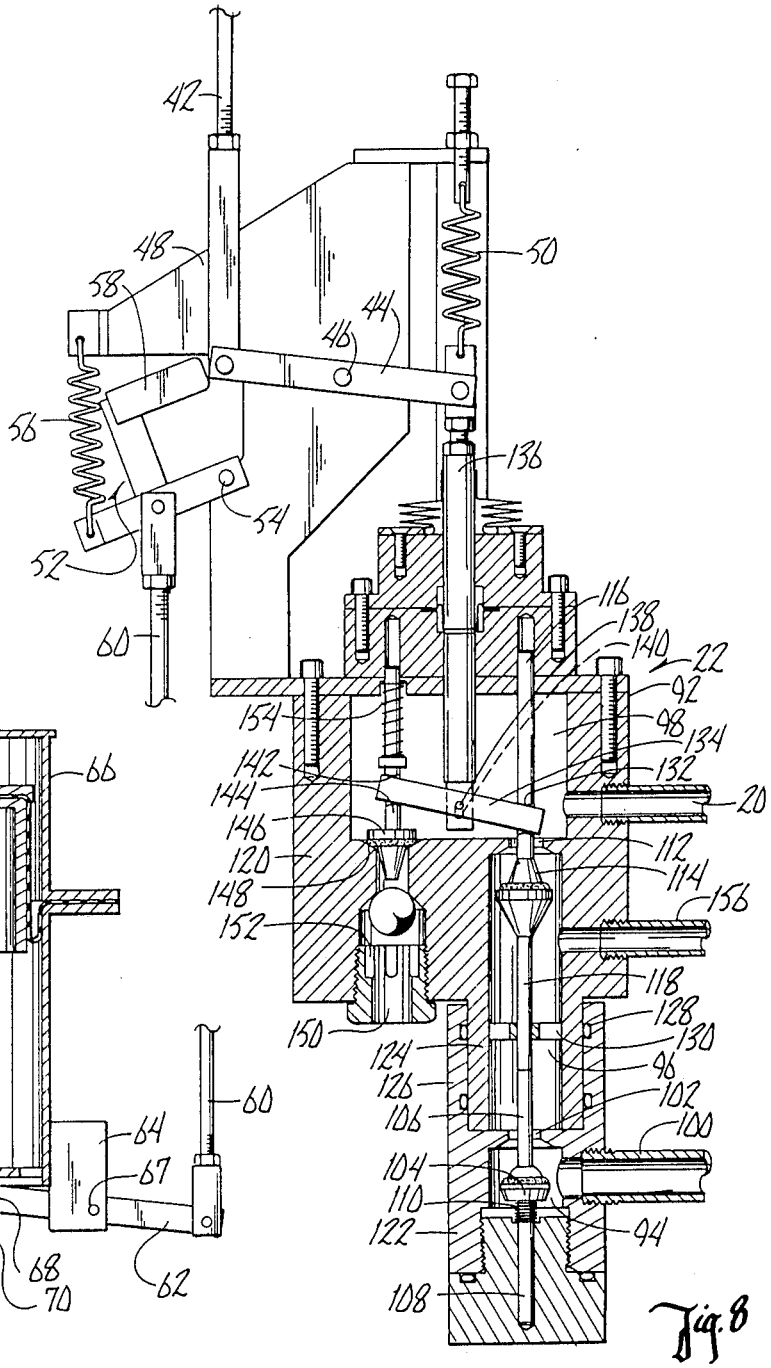
FIG. 8 is a view similar to FIGS. 6 and 7, but showing the position of the valve when the hydrant is in the on position.

Referring to FIGS. 6–8, main valve 22 includes a main valve housing 92 which encloses first, second and third chambers 94, 96, 98, respectively. First chamber 94 is adapted to be connected to a water main or water source line 100. First chamber 94 is connected to second chamber 96 by means of a valve opening 102. A valve 104 is adapted to be seated within valve opening 102 and includes an upper stem 106 and a lower stem 108. A spring 110 urges valve 104 upwardly to a seated position within valve opening 102 so as to normally maintain the valve 104 closed to prevent water pressure from entering second chamber 96. However, valve 104 may be urged downwardly against the bias of spring 110 to open chamber 96 to the water pressure from within water line 100.

Second chamber 96 is connected to first chamber 98 by means of a valve opening 112. A valve member 114 is adapted to be seated within valve opening 112 and includes an upper stem 116 and a lower stem 118. Lower stem 118 engages the upper stem 105 of valve 104 so that it can exert downward pressure on valve 104 to move valve 104 to its open position against the bias of spring 110.

Main valve housing 92 includes an upper portion 120 and a lower portion 122. Upper portion 120 includes a male connector 124 which is sealingly seated within a female receptacle 126 and is sealingly engaged therein by means of sealing rings 128.

It is possible to remove upper housing 120 from lower housing 122 merely by pulling upwardly on upper housing 120 so as to cause male connector 124 to be removed upwardly out of female connector 126. When this happens, spring 110 urges valve 104 to its upward closed position, thereby automatically disconnecting the valve from the water source 100. This permits the removal of the hydrant from the ground for repair without requiring the digging up of the hydrant and the shutting off of a main water line. When it is desired to reinsert the device, all that is necessary is to reinsert male connector 124 into female connector 126, and this forces the valve 104 to its open position, thereby reconnecting the hydrant to the water line 100.

A support ring 130 guides the valve stem 118 of valve member 114. The upper valve stem 116 of valve member 112 includes a slot 132 which receives the end of a control link 134 which is pivotally connected to the lower end of an actuator stem 136 for pivotal movement about an axis 138. A short elongated slot 140 provides a slight lost motion between actuator stem 136 and control link 134. While one end of link 134 is fitted within slot 132 of valve stem 116, the opposite end of link 134 is fitted within a slot 142 of a valve stem 144 having a valve member 146 seated within valve opening 148 which leads from chamber 98 to a drain line 150. A check valve 152 is provided in valve opening 148 so as to prevent back flow of fluid from drain line 150 into third chamber 98. Valve 146 is yieldably urged downwardly into seated engagement within valve opening 148 by means of a spring 154. The upper end of valve rod 136 is connected to link 44 and is also connected to spring 50 so as to be yieldably urged upwardly.

Nozzle 18 is in fluid communication with third chamber 98 by means of line 20 so that when fluid pressure is introduced into third chamber 98, the water is forced outwardly through nozzle 18.

Second chamber 96 is in fluid connection with a purge line 156 which leads to three-way valve 28.

Three-way valve 28 is connected by a line 158 to drain line opening 150, and both of these are connected by a further line 160 to the drain opening 86 of cylinder 66.

Figure 4:
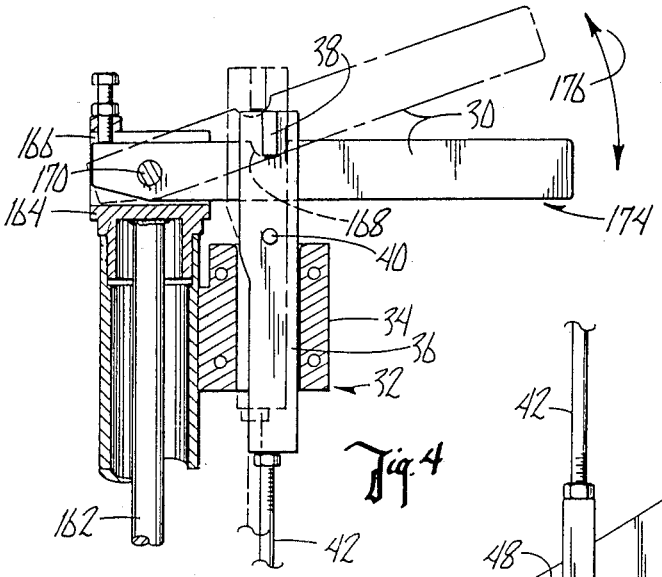
FIG. 4 is a side elevational view of the handle shown in FIG. 3.

Three-way valve 28 is operated mechanically by means of a shaft 162 which extends upwardly to the upper end of the hydrant and which is connected to a cap 164 having a clevis 166 (FIGS. 3 and 4) for pivotally receiving a handle 30 for pivotal movement about axis 170. Handle 30 includes a notch 168 therein for engaging the under edge of finger or pawl 38 as is shown in FIG. 4.

Handle 30 is movable to three positions. The first position is the off position designated by the numeral 172 in FIG. 3. The second position is the purge position designated by the numeral 174, and the third position is the on position designated by the numeral 176. Handle 30 moves about a vertical axis when moving from the off position 172 to the purge position 174. This places notch 168 immediately below finger or pawl 38. Handle 30 pivots about horizontal axis 170 when moving from the purge position 174 to the on position 176.

The device is operated as follows: Assuming that the hydrant has been previously operated and drain water has collected in the drain water chamber 82 of cylinder 66, the handle 30 is initially in the off position. In the off position, the piston 74 is lowered to its lowermost position so as to accommodate the drain water within drain water chamber 82. To turn the hydrant on, the lever 30 is moved against a spring force (not shown) from the off position to the purge position. This causes rotation of three-way valve 28 from the position shown in FIG. 5 to a position wherein the valve interconnects purge line 156 with water line 90 so as to introduce pressurized water through purge line 156 to the pressure chamber 84 within cylinder 66. It should be noted that purge line 156 is always pressurized from main valve 100 so long as the male connector 124 is seated within the female connector 126.

The introduction of fluid pressure into pressure chamber 84 forces the piston 72 upwardly to the position shown in FIG. 9. This upward movement of the piston forces the drain water stored within drain water chamber 82 upwardly through drain opening 86 and outwardly through drain line 26 where it is expelled above the ground.

When the piston 72 reaches its uppermost position, the lower head 76 engages the end 68 of link 62, thereby urging link 62 in a clockwise direction about its axis 67. This exerts a downward force on rod 60 and causes locking member 52 to rotate in a counterclockwise direction about axis 54 against the bias of spring 56. This removes the finger or pawl 58 from engagement with pivot link 44 and frees pivot link 44 to pivot upwardly.

The position of main valve 22 when the handle 30 is in its purge position, is shown in FIG. 7. In this position, the valve members 114, 146 are closed so that the pressure line 100 is in communication only with purge line 156.

To turn the hydrant on, handle 30 is lifted from the purge position to the on position as shown in shadow lines in FIG. 4. Notch 168 engages pawl 38 of actuator member 36 during this movement, and pulls actuator member 36 upwardly. This upward motion is permitted by virtue of the fact that locking member 52 has been pivoted to the release position by virtue of the upward movement of piston 72 during the purge cycle. The locking member 52 remains in its locked position until the purge cycle is completed, and therefore handle 30 cannot be moved from the purge position to the on position until after the cylinder 66 has been completely purged and the piston 72 has moved to its extreme upper position.

When the handle 30 is moved from the purge position to the on position, the valves within main valve member 22 are moved to the position shown in FIG. 8. In this position valve 146 is seated and valve member 114 is moved to its open position, thereby introducing fluid pressure from main line 100 into chamber 98 and outwardly through line 20 to outlet nozzle 18. This permits water to be released from nozzle 18 for normal operation. Throughout the normal operation of the hydrant, the piston 72 is maintained in its elevated position by virtue of continued pressure being introduced to the pressure chamber 84 during the operation of the nozzle.

When the hydrant is turned off, the first movement of handle 30 is from the off position to the purge position. This causes rod 136 to be moved upwardly, thereby causing the valves to be moved first to the position shown in FIG. 7 and then to the position shown in FIG. 6. The slot 140 within the lower end of stem 136 causes the valve member 114 to close prior to the time that valve member 146 is lifted upwardly and is opened. When valve member 146 moves to its open position, the nozzle 18 is placed into fluid communication with drain outlet 150.

Figure 5:
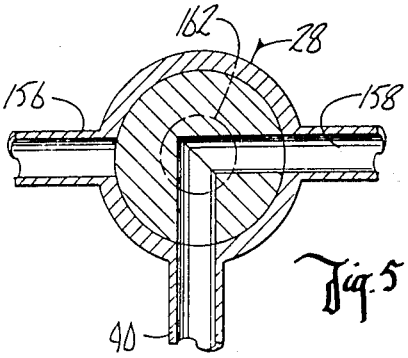
FIG. 5 is a sectional view taken along line 5—5 of FIG. 2.

The handle 30 is then moved from the purge position to the off position which causes rotation of three-way valve 28 to the position shown in FIG. 5. This places the pressure chamber 84 of cylinder 66 in communication with line 158 so that fluid within pressure chamber 84 can flow upwardly through line 58 and into communication with the drain water chamber 82. A check valve 178 is placed in line 158 so as to prevent back flow of fluid in line 158 toward pressure chamber 84. Similarly, the check valve 152 in main valve 22 prevents the flow of fluid into main valve 22, thereby preventing any of the water within the drain reservoir from becoming co-mingled with any water within valve 22.

As soon as handle 30 has been moved to its off position and three-way valve 28 has been placed in the position shown in FIG. 5, the residual water within nozzle 18 is free to drain downwardly through line 20 into chamber 98 and from chamber 98 downwardly through drain line opening 150 and line 160 into the drain water compartment 82 of cylinder 66. Piston 72 is free to move downwardly by virtue of the connection of pressure chamber 84 with drain water chamber 82. As the piston moves downwardly, the fluid from pressure chamber 84 passes through line 90, three-way valve 28, line 158 and line 160 into storage chamber 82.

Similarly, any residual water within drain line 26 also is permitted to flow downwardly by gravity into drain storage chamber 82. Thus, all the residual water within nozzle 18 and drain line 26 is permitted to drain downwardly into cylinder 66 so that it is stored below the frost line.

The next time that the handle 30 is moved from its off to its purge position, the pressure is introduced again to pressure chamber 84, thereby causing the purging of the drain water stored within drain water chamber 82.

The drain water system must be purged before the hydrant is turned on to avoid flooding the system which can cause freezing and which can also eliminate the sanitary feature of the hydrant whereby the drain water is kept separate from the water permitted to exit through nozzle 18. This is accomplished mechanically by the use of the locking member 52 which permits the handle 30 to be moved from the purge position to the open position only after cylinder 72 has reached its extreme upper position and has purged all the water from the drain water chamber 82.

The present invention permits the expelling of the drain water above the ground rather than below the ground as is the case in many prior art freezeless hydrants. Also, it keeps the drain water separate from any water later introduced to the outlet nozzle, thereby maintaining sanitary conditions and reducing the possibility that contaminated water can be introduced to the nozzle 18.

The hydrant can be easily disconnected from the main water line merely by lifting it upwardly and outwardly so as to unseat the male connector 124 from the female connector 126. It is not required that the water main be shut off to do this because valve member 104 automatically moves to the closed position during removal of the male member 124 from female connector 126.

The drain system of the hydrant operates automatically, and the force for expelling the drain water is provided by the water pressure from the main line 100.

Thus, it can be seen that the device accomplishes at least all of its stated objectives.

What is claimed is:

1. A ground hydrant comprising:

an outlet nozzle;

a drain water system comprising a cylinder having a piston therein dividing said cylinder into a pressure chamber and a drain water chamber on opposite sides of said piston, a pressure opening being in said cylinder for permitting water to enter and exit said pressure chamber, a drain opening being in said cylinder for permitting water to enter and exit said drain water chamber, a drain line being connected to said drain opening, said piston being movable from a drain position to a purge position for causing water to be forced out of said drain water chamber through said drain opening and said drain line, and being movable from said purge position to said drain position to permit water to drain into said drain water opening;

a selective valve means connected to both of said drain opening and said pressure opening of said cylinder;

main valve means adapted for fluid connection to a source of water pressure, and also being fluidly connected to said outlet nozzle, said second valve means, and said drain opening of said cylinder, said main valve means being movable to an off position, wherein selective valve means is connected to said water source and said outlet nozzle is closed off from said water source and said drain opening of said cylinder, said main valve means also being movable to an on position wherein said outlet nozzle, said selective valve means, and said water source are in communication with one another and are closed off from said drain opening of said cylinder;

said main valve means also being movable to a drain position wherein said outlet nozzle and said drain opening of said cylinder are connected to one another and are closed off from said water source;

said selective valve means being movable from a purge position connecting said main valve means to said pressure opening of said cylinder to a drain fill position connecting said pressure opening of said cylinder to said drain opening of said cylinder;

manually operable mechanism connected to said main valve means and said selective valve means for selectively moving said main valve means to said on, off, and drain positions, and for selectively moving said selective valve means to said purge and drain fill positions.

2. A ground hydrant according to claim 1 comprising check valve means between said drain opening of said cylinder and said main valve means for preventing back flow of water from said cylinder into said main valve means.

3. A ground hydrant according to claim 1 wherein said manually operable mechanism includes lock means having a locked position for holding said main valve means against movement to said on position, said lock means being movable to an unlocked position permitting movement of said main valve means to said on position.

4. A ground hydrant according to claim 3 wherein a lock linkage interconnects said lock means and said cylinder, said lock linkage being engagable by and responsive to said piston when said piston is in said purge position for causing said lock means to move to said unlocked position.

5. A ground hydrant according to claim 1 wherein said manually operable mechanism comprises an actuator handle, a first rod extending from said main valve means upwardly to said actuator handle, and a second rod connected to said actuator handle and engagable with said main valve means.

6. A method for automatically draining a ground hydrant having a nozzle above the ground and a cylinder located below the ground, said cylinder having a piston therein dividing said cylinder into a drain water chamber and a pressure chamber, said cylinder having a pressure opening providing communication into said pressure chamber and a drain opening providing communication into said drain water opening; a drain line being connected to said drain opening and extending upwardly to a drain outlet above ground, said method comprising:

connecting said nozzle to a pressurized water source whereby pressurized water will be forced outwardly from said nozzle;

providing valve means for shutting off said nozzle from said water source and connecting said nozzle to said drain opening of said drain water chamber;

providing fluid communication between said pressure chamber and said drain water chamber whereby the residual water within said nozzle and said drain line will drain by gravity into said drain water chamber and said piston will move toward said pressure chamber in response thereto so as to enlarge said drain water chamber to accommodate said drained residual water;

providing check valve means between said drain opening and said valve means for preventing back flow of water from said drain opening of said cylinder toward said nozzle;

providing valve control control means between said cylinder and said valve means for selecting a fluid communicative condition, for pressurization of said cylinder and for purging said drain water chamber;

purging said drained residual water from said drain water chamber by closing off said communication between said pressure and drain water chambers and by moving said piston toward said drain water chamber to force water outwardly onto the ground through said drain opening, said drain line, and said drain outlet upon movement of said valve means from an open position to a drain position.

* * * * *